US007695119B2

(12) United States Patent
Ito

(10) Patent No.: US 7,695,119 B2
(45) Date of Patent: Apr. 13, 2010

(54) LIQUID DISCHARGING HEAD AND LIQUID DISCHARGING APPARATUS

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 282 days.

(21) Appl. No.: 11/598,329

(22) Filed: Nov. 13, 2006

(65) Prior Publication Data

US 2007/0109364 A1 May 17, 2007

(30) Foreign Application Priority Data

Nov. 14, 2005 (JP) ..... 2005-328699

(51) Int. Cl.
*B41J 29/377* (2006.01)
*B41J 2/045* (2006.01)

(52) U.S. Cl. ..... 347/71; 347/18

(58) Field of Classification Search ..... 347/18, 347/71

See application file for complete search history.

(56) References Cited

U.S. PATENT DOCUMENTS 5,128,694 A * 7/1992 Kanayama ..... 347/72
6,595,628 B2 7/2003 Takagi et al.
2004/0189730 A1 9/2004 Kubo

FOREIGN PATENT DOCUMENTS

JP 2002-254634 9/2002
JP 2004-291342 10/2004

* cited by examiner

*Primary Examiner*—Julian D Huffman
(74) *Attorney, Agent, or Firm*—Eugene Ledonne; Joseph W. Treloar; Frommer Lawrence & Haug LLP

(57) ABSTRACT

An ink-jet head, as a liquid discharging head, includes a cavity unit, a flexible flat cable, a plurality of actuators, and a thermal conductive member. The thermal conductive member is in contact with the actuators so that heat is transmitted to the actuators. Accordingly, it is possible to realize a liquid discharging head which performs a recording of high quality while suppressing an excessive local heating of the ink-jet head and heating up, to a high temperature, of the ink-jet head due to heat generated from the actuators, thereby suppressing occurrence of a temperature gradient between the actuators so as to prevent the decline in recording quality due to the temperature difference.

20 Claims, 9 Drawing Sheets

LIQUID DISCHARGING HEAD AND LIQUID DISCHARGING APPARATUS

CROSS REFERENCE TO RELATED APPLICATION

The present application claims priority from Japanese Patent Application No. 2005-328699, filed on Nov. 14, 2005, the disclosure of which is incorporated herein by reference in its entirety.

BACKGROUND OF THE INVENTION

1. Field of the Invention

The present invention relates to a liquid discharging head (liquid jetting head) and a liquid discharging apparatus (liquid jetting apparatus) each having a structure in which a cavity unit and an actuator are laminated or stacked in layers.

2. Description of the Related Art

There has hitherto been known an ink-jet head including a cavity unit which has a plurality of nozzle rows arranged on a front surface thereof and an ink distribution channel (ink channel) formed therein; an actuator which selectively applies a discharge pressure (jetting pressure) to an ink in the cavity unit; and a flexible flat cable which transmits a driving signal to this actuator.

In the ink-jet head having such a structure, sometimes the actuator generates heat during a recording operation. When this heat is excessive or concentrated locally, a viscosity of the ink is changed, and discharge characteristics (jetting characteristics) from the nozzle are affected. Due to this, there is a fear that recording quality is lowered, and/or an operation failure of the actuator is caused, for example.

SUMMARY OF THE INVENTION

To solve such problems, the applicant of this patent application discloses, in U.S. patent application Publication No. US 2004/189730 A1 (paragraph [0046] and FIG. 7, corresponding to Japanese Patent Application Laid-open No 2004-291342 (paragraph [0037] and FIG. 6)) an ink-jet head having a structure in which a radiator is further provided to radiate a heat of the actuator to an outside, and this radiator is stacked on a head unit. Further, in the ink-jet head described in U.S. patent application Publication No. US 2004/189730 A1, a heat sink which releases a heat of a driver device mounted on the flexible flat cable is provided. Thus, by providing the heat sink and the radiator, it is possible not only to prevent the heat of the driver element from being transmitted to the actuator from the heat sink, but also to radiate, by the radiator, the heat generated by the actuator itself. Therefore, it is possible to realize the stabilization of operation of the actuator.

Incidentally, accompanying with the demand for high-speed recording and for high densification of the recording in recent years, there has been a tendency that the number of nozzles is increased in an ink-jet head. In U.S. patent application Publication No. US 2004/189730 A1, one ink jet is formed by arranging two head units so as to increase the number of nozzles. Therefore, one ink-jet head includes two actuators. Since the actuators are driven individually, in such case, sometimes there is a difference, between the actuators, in an amount of heat generated by the actuators. Therefore, when the radiator is provided corresponding to each of the actuators, a temperature gradient is generated in the one ink-jet head. Since this temperature gradient causes not only the variation in operation characteristics between the actuators, but also causes the variation in discharge characteristics among nozzles, there is a fear that the recording performance of the ink-jet head as a whole is compromised or decreased.

The present invention is made to solve the abovementioned problems, and an object of the present invention is to realize an ink-jet head which has at least two actuators, and which gives excellent recording quality while preventing the ink-jet head from being locally excessively heated or from being heating up to high temperature due to heat generated by the actuators themselves, and suppressing temperature gradient between or among the actuators. Another object of the present invention is to realize an ink-jet printer, as an image recording apparatus, which is provided with such an ink-jet head.

According to a first aspect of the present invention, there is provided a liquid discharging head which discharges a liquid, including:

a cavity unit including a channel through which the liquid flows, and a plurality of nozzles;

a plurality of actuators which selectively apply a discharge pressure to the liquid in the cavity unit, and which are arranged on a surface of the cavity unit; and a thermal conductive member which is arranged on two adjacent actuators among the actuators so that the two adjacent actuators are intervened between the thermal conductive member and the cavity unit and that the thermal conductive member thermally connects the two adjacent actuators.

According to the first aspect of the present invention, the thermal conductive member which connects at least two adjacent actuators is arranged as described above. Therefore, in addition to that the heat generated in the actuator is transmitted to the thermal conductive member to be released or radiated (heat radiation), the heat is transmitted to the entire thermal conductive member and thus the temperature of the actuator becomes uniform (is uniformized). Accordingly, even when the amount of heat differs between the actuators due to the variation in the discharge operation among the actuators, the temperature gradient between the actuators is suppressed by the thermal conductive member, thereby making it possible to suppress the variation in the operation characteristics between the actuators, and the variation in the discharge characteristics among the nozzles. In the present invention, a sentence "the thermal conductive member thermally connects the two adjacent actuators" means that the thermal conductive member and each of the actuators are connected thermally, and that the two actuators are connected thermally via the thermal conductive member. In this case, the thermal conductive member and the actuators may be connected directly, or the thermal conductive member and the actuators may be connected via a separate member such as a flexible flat cable (FPC).

The liquid discharging head of the present invention may further includes a flexible flat cable which transmits a driving signal to the actuators; and the liquid discharging head may be an ink-jet head which discharges an ink. In this case, even in a case that the flexible flat cable (FPC) is provided, it is possible to suppress temperature gradient between the actuators. Further, by applying the liquid discharging head of the present invention to an ink-jet head, it is possible to perform recording of a high quality.

In the liquid discharging head of the present invention, the flexible flat cable may be provided on surfaces, of the actuators, on the side opposite to the cavity unit; and the thermal conductive member may be arranged on the actuators via the flexible flat cable.

In this case, since the flexible flat cable is arranged on the actuators, and further the thermal conductive member is arranged thereon, it is possible to perform an operation of discharging the ink selectively from the nozzles while suppressing the variation in the operation characteristics between the actuators and the variation in the discharge characteristics among the nozzles, by transmitting the heat of the actuator or actuators to the thermal conductive member via the flexible flat cable.

The liquid discharging head of the present invention may further include a reinforcing frame which includes an outer peripheral portion surrounding a periphery of each of the actuators;

the reinforcing frame may be arranged on the surface of the cavity plate on which the actuators are arranged; and the thermal conductive member may have flat portions which are arranged on the actuators, and a connecting portion which joins the flat portions, and the thermal conductive member may be arranged on inside of the outer peripheral portion of the reinforcing frame.

In this case, since the thermal conductive member is arranged on the actuator at the flat portions thereof, the heat generated in one of the actuators is transferred efficiently from one of the flat portions to the thermal conductive member, and is transmitted, by the connecting portion, to the other of the flat portions. Further, since the thermal conductive member is arranged on inside of the reinforcing frame (an area disposed inside of the reinforcing frame), it is possible to eliminate the temperature gradient between the actuators as described above, while improving a stiffness of the ink-jet head as a whole by the reinforcing frame.

In the liquid discharging head of the present invention, the reinforcing frame may be provided with a column portion which continues to the outer peripheral portion and which is disposed at a portion between the two adjacent actuators; and a depression straddling over the column portion may be formed on a surface of the connecting portion of the thermal conductive member, the surface facing the column portion.

In this case, even when the plurality of actuators is provided, the liquid discharging head is provided with the column portion (crosspiece or bridge) of the reinforcing frame disposed at a portion between the actuators. Accordingly, as compared with a reinforcing frame having only the outer peripheral portion, it is possible to improve the entire stiffness. In addition to this, the depression is formed in the connecting portion of the thermal conductive member such that the column portion can straddle over the column portion. Accordingly, even when the reinforcing frame having the column portion is attached to the cavity unit, it is possible to attach the thermal conductive member connecting the adjacent actuators, thereby making it possible to eliminate the temperature gradient between the actuators as described above.

In the liquid discharging head of the present invention, the connecting portion of the thermal conductive member may have a curved shape and may straddle over the column portion; and a thickness of the connecting portion may be greater than a thickness of the flat portions.

In this case, since the thickness of the connecting portion is greater than the thickness of the flat portions, a heat resistance in the connecting portion is decreased than in the flat portions, and the heat is transmitted rapidly between the adjacent flat portions.

In the liquid discharging head of the present invention, the reinforcing frame may be provided with a column portion which is disposed at a portion between the two adjacent actuators and which continues to the outer peripheral portion;

the column portion may be divided to define a gap with a predetermined spacing distance; and the connecting portion of the thermal conductive member may have a size such that the connecting portion is accommodated in the gap.

In this case, since a cut line is formed in the column portion of the reinforcing frame and a width of the connecting portion is formed to be thin, it is not necessary to form a depression or the like in the connecting portion to straddle over the column portion, thereby making it possible to perform a processing of the thermal conductive member easily.

In the liquid discharging head of the present invention, a heat insulating material which suppresses a heat radiation from the connecting portion may be fixed on a surface of the connecting portion of the thermal conductive member.

In this case, by fixing the heat insulating material to the connecting portion so as to suppress the heat radiation from the connecting portion, it is possible to facilitate a thermal conductivity between the flat portions via the connecting portion, namely to facilitate the temperature of the actuator to be uniform.

In the liquid discharging head of the present invention, the cavity unit may further include a plurality of pressure chambers, and the pressure chambers may communicate with the channel, and may be open toward the surface of the cavity unit on which the actuators are arranged; and each of the actuators may include a plurality of piezoelectric bodies each of which has a shape of a flat plate, and the piezoelectric bodies may cover the pressure chambers so as to divide the pressure chambers into groups corresponding to the piezoelectric bodies, respectively.

Even when the number of nozzles and ink channels is increased in response to the high-speed recording and high densification of the recording, it is possible to easily form the nozzles and ink channels in large sizes since the cavity unit is made of a metal or the like. However, the actuator made of the piezoelectric body is shrunk when baked or calcinated. Accordingly, when the actuator is made to be of a large size, it is difficult to make the actuator correspond accurately with a plurality of ink channels. On the other hand, in the present invention, the actuator has at least two piezoelectric bodies each formed in form of a flat plate covering the pressure chambers so as to divide the pressure chambers into groups corresponding to the piezoelectric bodies, respectively. Accordingly, even when the number of nozzles and/or the like is increased, it is easy to make the actuators correspond accurately to the pressure chambers. Furthermore, even when the amount of heat generated by these piezoelectric bodies is different between the piezoelectric bodies, the temperature gradient between the piezoelectric bodies is suppressed by the thermal conductive member in a manner as described above, and thus it is possible to perform a high-quality recording.

In the liquid discharging head of the present invention, the flexible flat cable may be a chip-on flexible cable which includes an IC chip. In this case, the IC chip is mounted on the flexible flat cable. However, since the heat from the IC chip is radiated via the thermal conductive member, there is no adverse effect on the actuator.

In the liquid discharging head of the present invention, the thermal conductive member may be formed of a material which is selected from a group consisting of aluminum, copper, and stainless steel. In any of the cases, it is possible to improve the thermal conductivity of the thermal conductive material sufficiently, and to thermally conduct (soak) the heat of the actuator efficiently.

According to a second aspect of the present invention, there is provided a liquid discharging apparatus which discharges a liquid onto an object, the apparatus including:

a transporting mechanism which transports the object in a predetermined direction; and a head which includes: a cavity unit including a channel through which the liquid flows, and a plurality of nozzles; a plurality of actuators which selectively apply a discharge pressure to the liquid in the cavity unit, and which are arranged on a surface of the cavity unit; and a thermal conductive member which is arranged on two adjacent actuators among the actuators so that the two adjacent actuators are intervened between the thermal conductive member and the cavity unit and that the thermal conductive member thermally connects the two adjacent actuators.

According to the second aspect of the present invention, the temperature gradient between the actuators is suppressed by the thermal conductive member, and it is possible to suppress the variation in operation characteristics between the actuators and to suppress the variation in discharge characteristics among the nozzles. Therefore, it is possible to improve the printing performance.

DETAILED DESCRIPTION OF THE PREFERRED EMBODIMENTS

Figure 1:
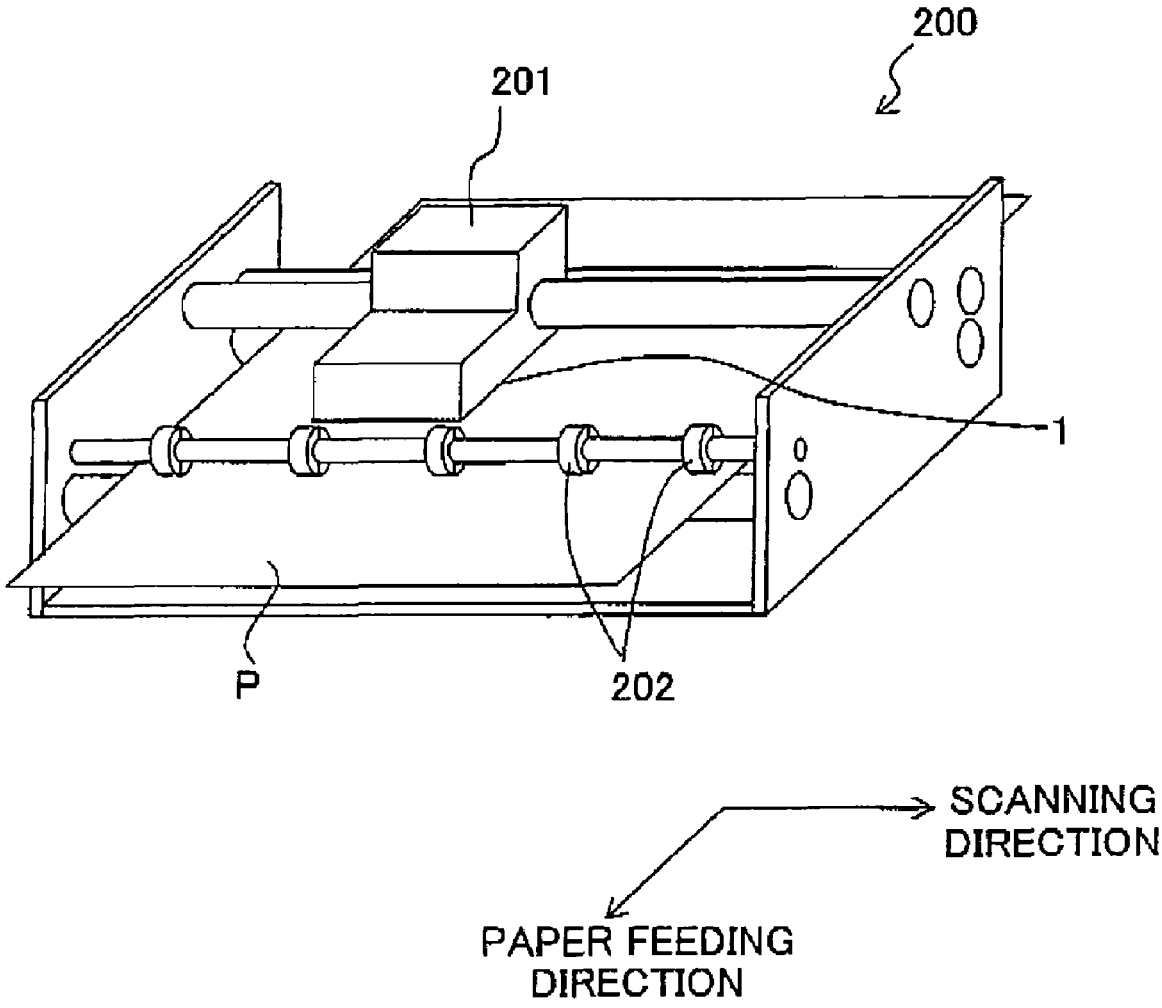
FIG. 1 is a schematic perspective view of an ink-jet printer according to an embodiment of the present invention.

A basic embodiment of the present invention will be explained with reference to FIGS. 1 to 7. FIG. 1 is a schematic perspective view of an ink-jet printer as a liquid discharging apparatus according to an embodiment of the present invention. As shown in FIG. 1, an ink-jet printer 200 includes a carriage 201 which is movable in a scanning direction (left and right direction in FIG. 1); an ink-jet head 1 of serial type which is attached to the carriage 201 and which jets an ink onto a recording paper P; and paper feeding rollers 202 which transport or feed the recording paper P in a paper feeding direction (forward direction in FIG. 1). The ink-jet head 1 performs recording by jetting the ink onto the recording paper P from nozzles 7 (see FIG. 4) provided on a lower surface of the carriage 201 while moving integrally with the carriage 201 in the scanning direction. The recording paper P with the printing performed thereon is discharged in the paper feeding direction by the paper feeding rollers 202.

Figure 2:
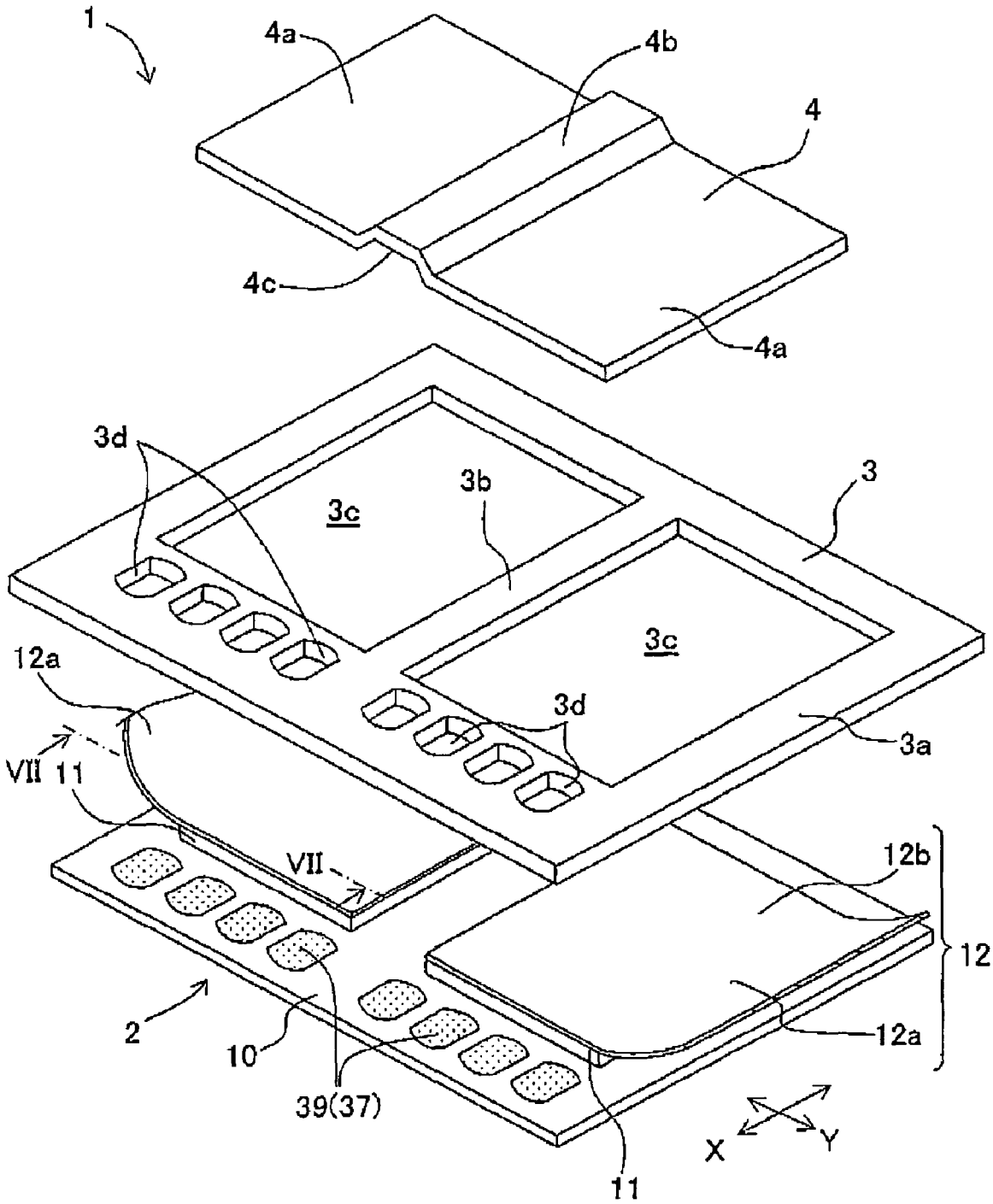
FIG. 2 is an exploded perspective view of an ink-jet head of the embodiment.

FIG. 2 is a perspective view of an ink-jet head 1 of a piezoelectric type, as a liquid droplet jetting head according to the embodiment of the present invention. The ink-jet head 1 includes a head unit 2 which is a stack of a cavity unit 10, piezoelectric actuators 11, and flexible flat cables 12, a reinforcing frame 3 which is fixed on a rear surface (upper surface in FIG. 2) of the cavity unit 10, and a soaking member (thermal conductive member) 4 which is arranged on rear surfaces of the flexible flat cables 12. The ink is discharged downward from a front surface side (lower surface in FIG. 2) of the cavity unit 10.

Figure 4:
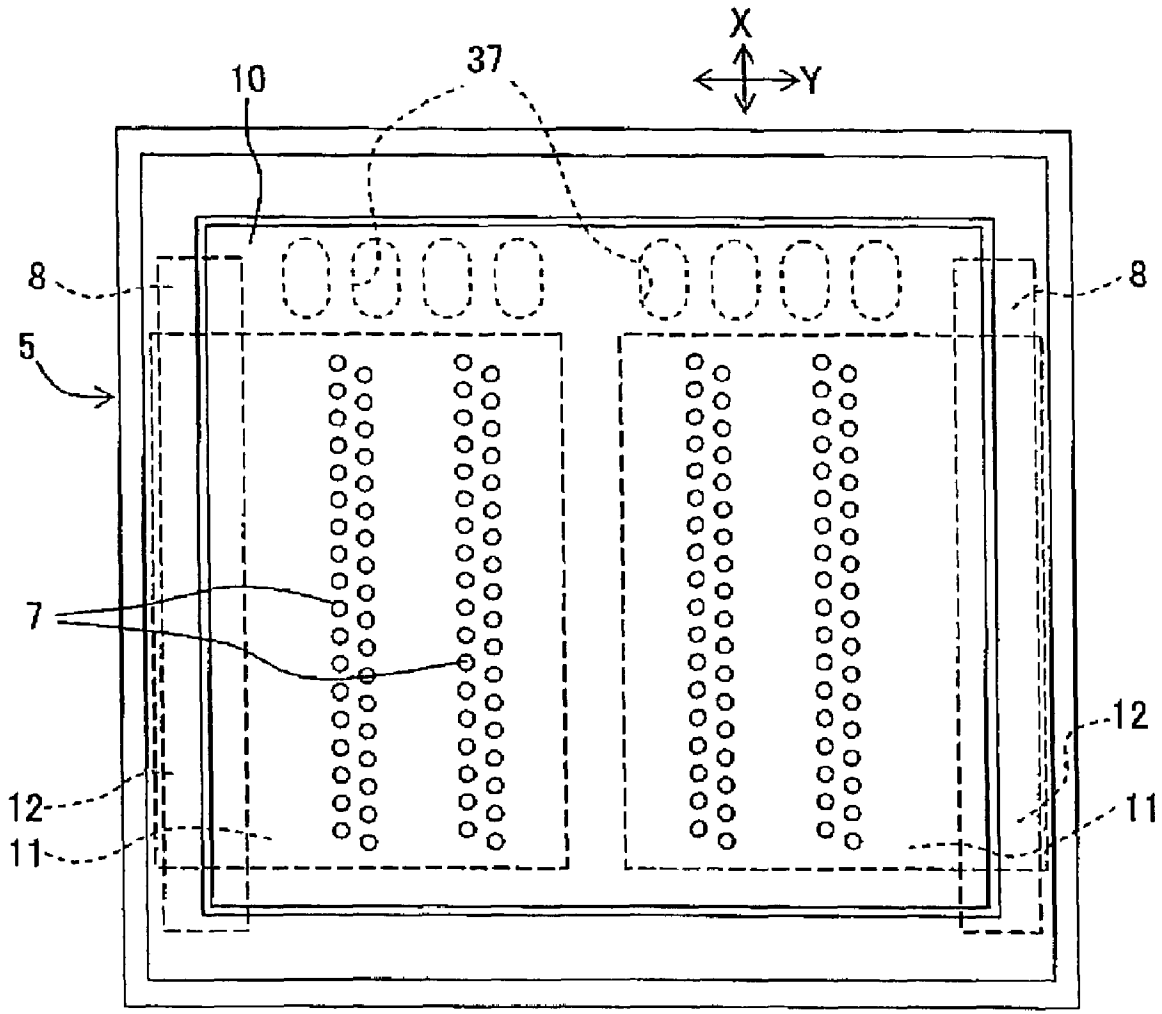
FIG. 4 is a bottom view of the ink-jet head.

The head unit 2 is in a form of a plate having a substantially rectangular shape. The nozzles 7 which discharge (jet) the ink are formed in a front surface (one surface of broad surfaces, lower surface) of the cavity unit 10 (see FIG. 4). The two piezoelectric actuators 11 are arranged side by side on a rear surface (other surface of the broad surfaces, upper surface) of the cavity unit 10, and the flexible flat cables 12 are arranged on the piezoelectric actuators 11, respectively. As shown in FIG. 4, the nozzles 7 are arranged in eight rows (eight nozzle rows).

Figure 3:
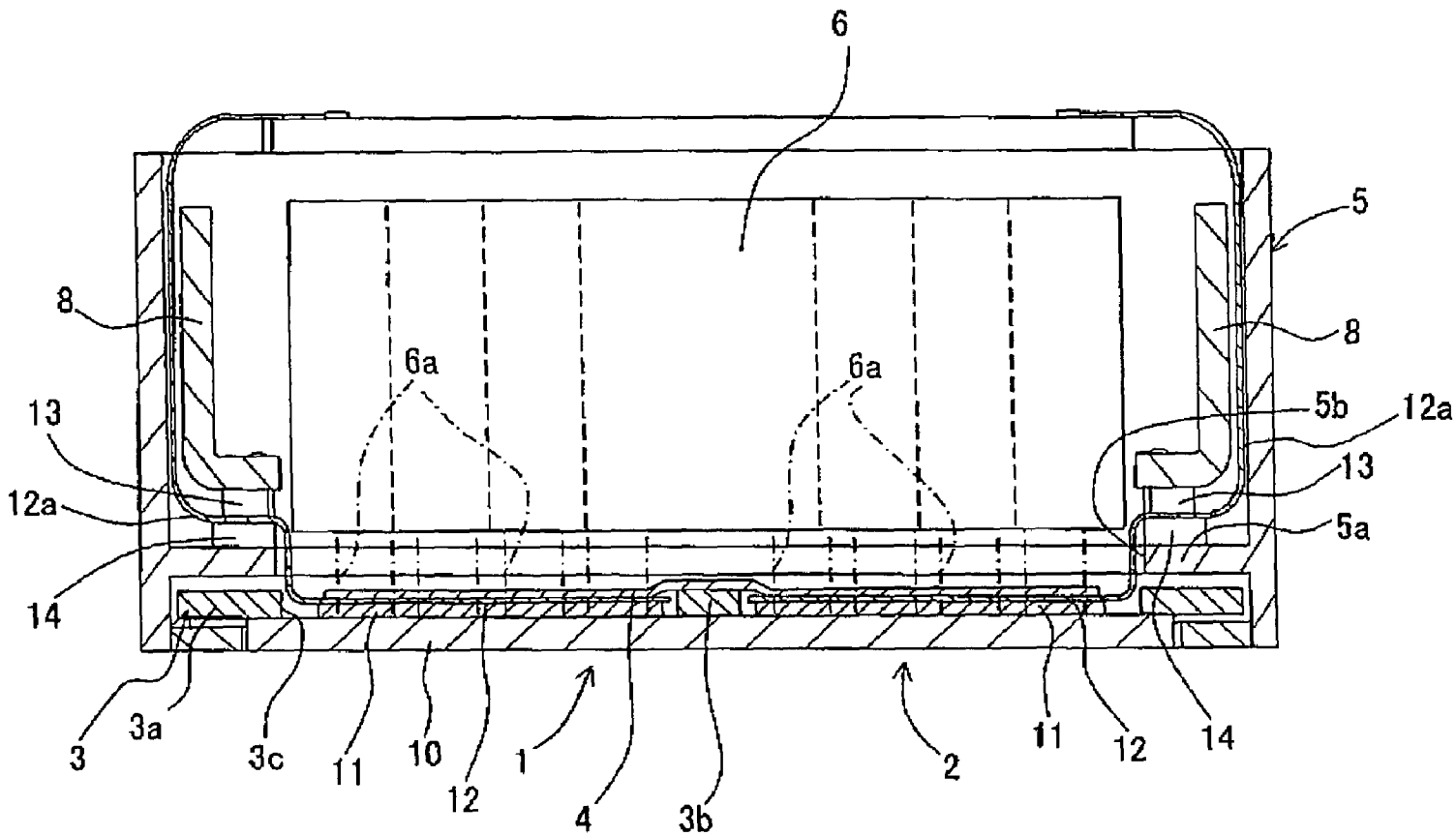
FIG. 3 is a vertical cross-sectional view of a head holder on which the ink-jet head is mounted.

In an image recording apparatus such as an ink-jet printer, this ink-jet head 1 is attached or provided on a carriage (not shown in the diagram) which is driven to reciprocate in a main scanning direction (Y direction) and which discharges (jets) an ink onto a recording medium. As shown in FIG. 3, a head holder 5 having roughly a box shape is provided on the carriage, and the ink-jet head 1 is fixed under a base plate 5*a* of the head holder 5, almost parallel to the base plate 5*a* in a state that a surface of the ink-jet head 1, in which the nozzles 7 are open, are exposed downward. An ink storage section (damper unit) 6 which stores the ink supplied, toward the carriage, from an ink supply source (not shown in the diagram) provided on a body of the image recording apparatus is attached above the base plate 5*a* of the head holder 5. A through hole 5*b* is formed in the head holder 5 at the bottom plate 5*a* thereof, and ink outflow ports 6*a* of the ink storage section 6 and connecting ports 3*d* (see FIG. 2) of the ink-jet head 1 are connected via this through hole 5*b*, whereby the ink is supplied from the ink storage section 6 to the head unit 2. The inside of the ink storage section 6 is divided or partitioned into a plurality of ink chambers, and inks of different colors, stored in the ink chambers corresponding to the colors, respectively, are supplied individually to the head unit 2.

As shown in FIG. 3, in this embodiment, the ink storage section 6 is divided into seven ink chambers, and one of these seven ink chambers is bigger than the other six ink chambers. As shown in FIGS. 2 and 3, eight ink outflow ports 6*a* and eight connecting ports 3*d* are provided. Black ink which is used highly frequently is stored in the big ink chamber, from where the big ink chamber is branched into two and supplied to the head unit 2. Inks of three colors other than black, such as yellow, magenta, and cyan may be stored in the other six ink chambers with the ink of the same color in two ink chambers, or inks of six colors including the inks of yellow, magenta, and cyan may be stored individually in the six chambers, respectively.

The reinforcing frame 3 is made of a material having a stiffness (for example, a metallic plate such as SUS (stainless steel)), and includes an outer peripheral portion 3*a* which surrounds the peripheries of the two piezoelectric actuators 11, and a column portion 3*b* which is disposed at a portion between the two piezoelectric actuators 11. The piezoelectric actuators 11 are positioned in two opening areas 3*c*, respectively, defined by the outer peripheral portion 3*a* and the column portion 3*b*, and the reinforcing frame 3 is fixed by an adhesive or the like, while overlapping the reinforcing frame 3 with a portion, of the cavity unit 10, on a rear surface thereof and near the outer periphery of the cavity unit 10. Each of the flexible flat cable (FPC) 12 includes a portion 12*b* which is closely adhered to the rear surface of one of the piezoelectric actuators 11, and a flexible portion 12*a* which continues to the portion 12*b*. The flexible portion 12*a* of the flexible flat cable 12 is drawn on the reinforcing frame 3. The connecting ports 3*d* which connect the ink outflow ports 6*a* of the ink storage section 6 and ink supply ports 37 of the head unit 2 are provided to the outer peripheral portion 3*a* of the reinforcing frame 3.

The soaking member 4 is made of a material having a high thermal conductivity (such as a metallic plate of aluminum, copper, SUS or the like), and is arranged on the flexible flat cables 12 straddling over the two adjacent piezoelectric actuators 11. Accordingly, in addition to radiating the heat generated in the piezoelectric actuators 11, the heat is made to be almost uniform between the two piezoelectric actuators 11. Further, the soaking member 4 also brings about an effect of improving the stiffness of the head unit 2. The soaking member 4 includes two flat portions 4*a* which are tightly contact with the flexible flat cables 12 with the adhesive, respectively, and a connecting portion 4*b* which connects the two flat portions 4*a*; and a depression 4*c* straddling over the column portion 3*b* of the reinforcing frame 3 is provided in the connecting portion 4*b*. In this embodiment, the soaking member 4 is formed of a flat metallic plate with a process such as press-working, cutting, or the like.

Figure 5:
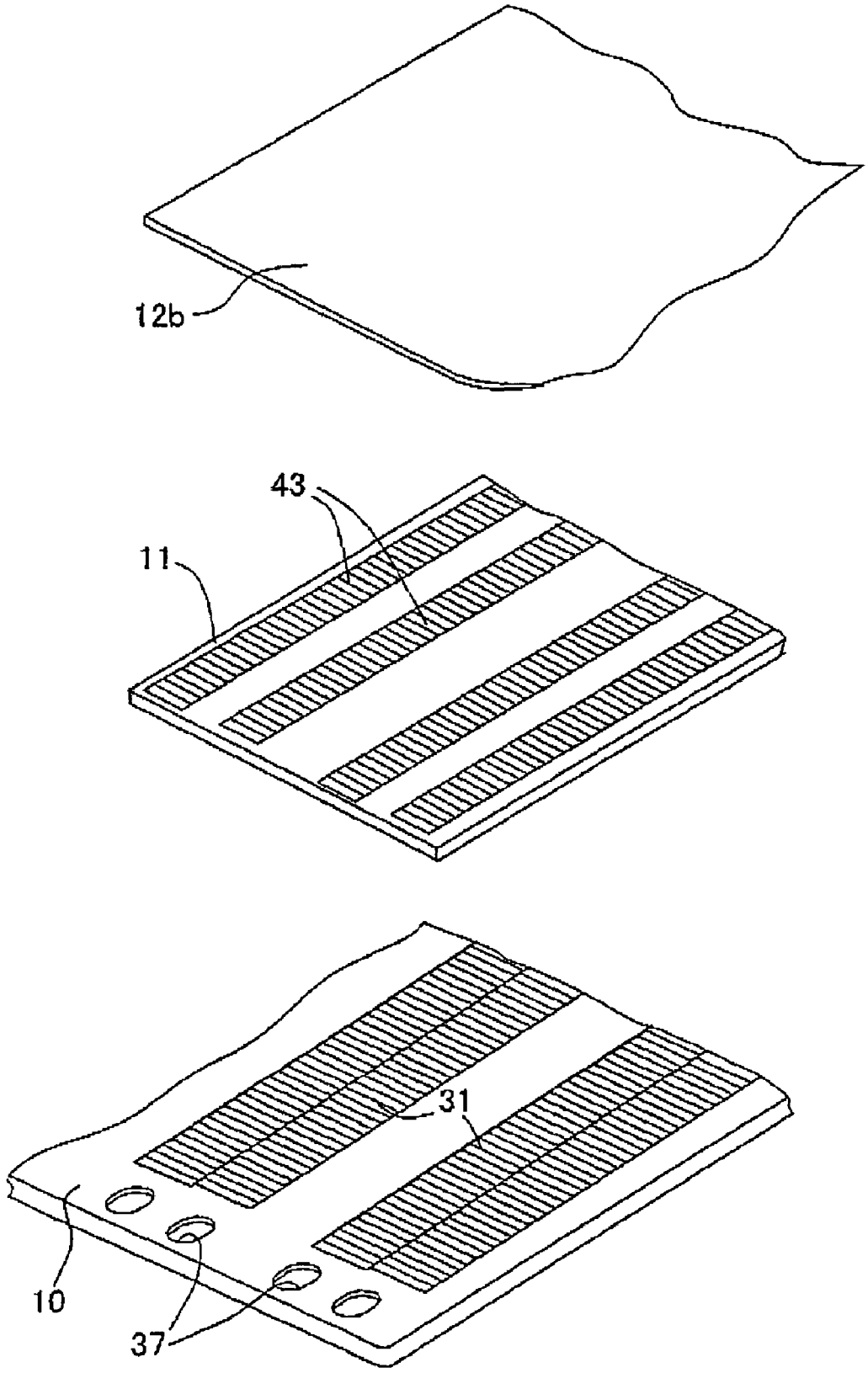
FIG. 5 is a perspective view in which a cavity unit, a piezoelectric actuator, and a flexible flat cable are disassembled.
Figure 6:
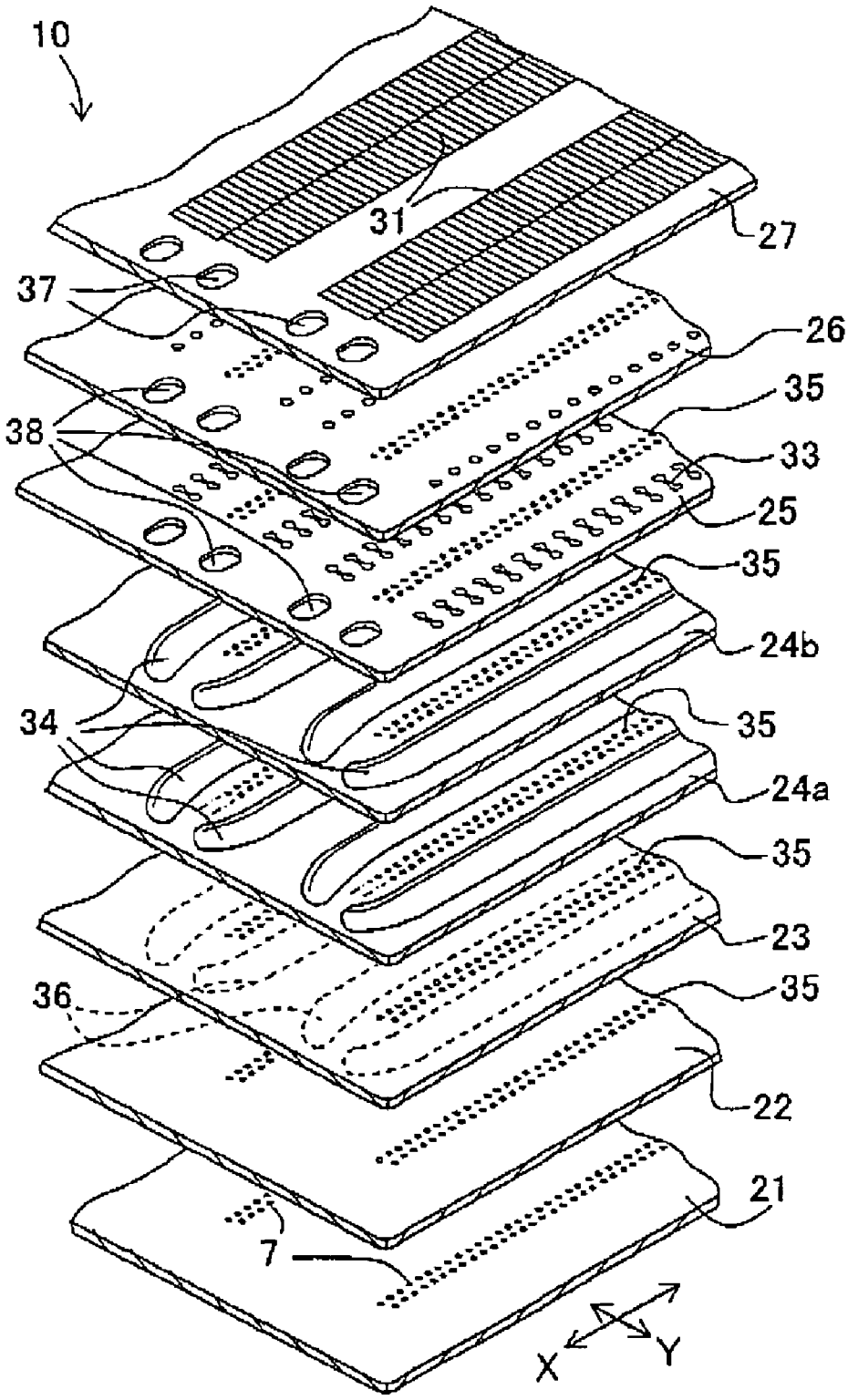
FIG. 6 is a partial exploded perspective view of the cavity unit.

The cavity unit 10 includes a total of eight thin flat plates, namely a nozzle plate 21, a spacer plate 22, a damper plate 23, two manifold plates 24*a* and 24*b*, a supply plate 25, a base plate 26, and a cavity plate 27. These eight plates are stacked such that surfaces of these flat plates are facing mutually, and are joined with an adhesive so as to form the cavity unit 10. FIGS. 5 and 6 are diagrams each showing the cavity unit 10 partially.

In the embodiment, each of the plates 21 to 27 has a thickness of about 40 μm to 150 μm. The nozzle plate 21 is made of a synthetic resin material such as polyimide, and the remaining plates 22 to 27 are made of a 42% nickel alloy steel plate. A large number of nozzles 7 for discharging the ink are formed at a minute or very small spacing distance in the nozzle plate 21, and a diameter of each of the nozzles 7 is about 20 μm. Eight rows of nozzles 7, arranged side by side at a spacing distance in a Y direction, are formed in the nozzle plate 21, and each of the nozzle rows includes a plurality of nozzles 7 arranged in a direction (X direction) which is orthogonal to the main scanning direction (Y direction).

Figure 7:
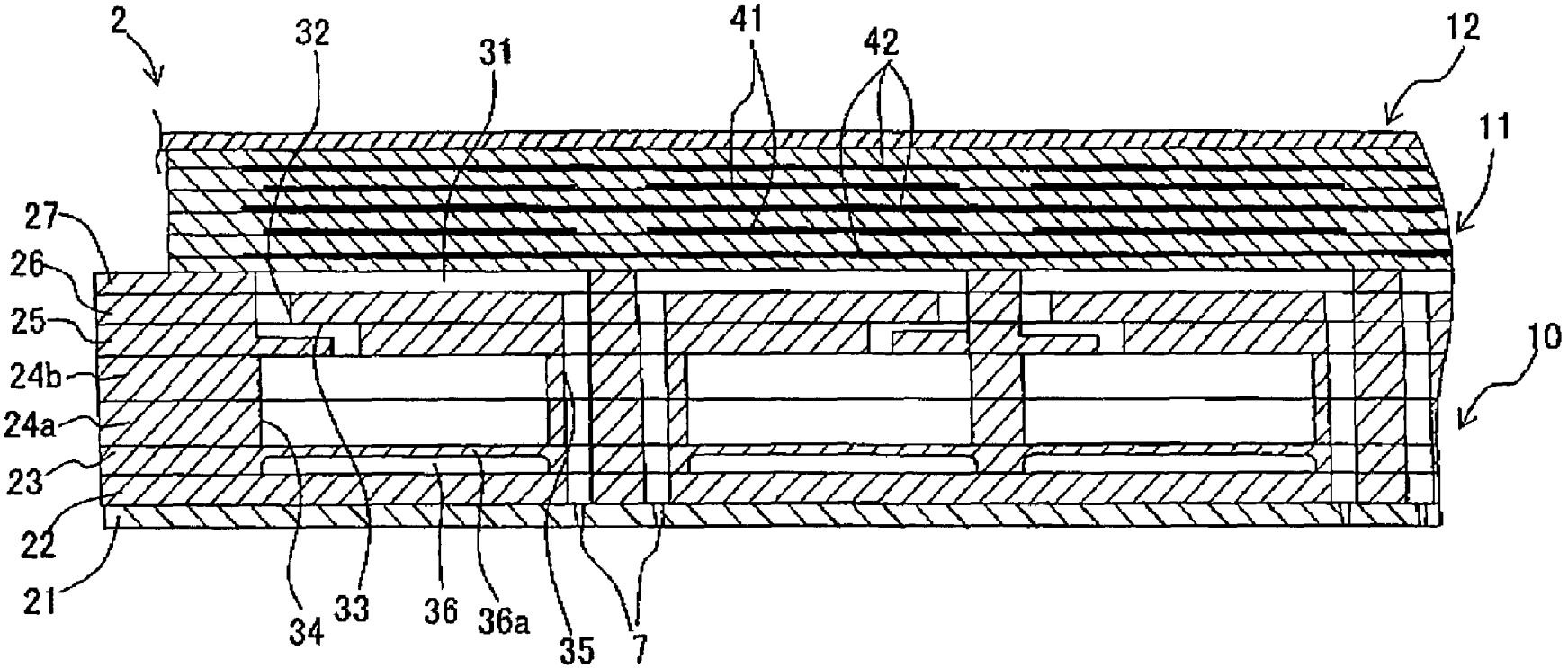
FIG. 7 is a cross-sectional view taken along a line VII-VII shown in FIG. 1.

The nozzles 7 are communicated with pressure chambers 31, respectively, in the cavity plate 27, via through holes (channel, ink channel) 35 formed in the spacer plate 22, the damper plate 23, the two manifold plates 24*a* and 24*b*, the supply plate 25, and the base plate 26. In the cavity plate 27, a plurality of pressure chambers 31 is arranged in eight rows in the Y direction. As shown in FIGS. 6 and 7, each of the pressure chambers 31 is formed in the cavity plate 27, as an elongated through hole of which a longitudinal direction is along the Y direction. One end, of each of the pressure chambers 31, in the longitudinal direction communicates with a communicating hole 32 which will be described later, and further communicates with a common ink chamber 34 via a connecting channel 33. The other end, of each of the pressure chambers 31, in the longitudinal direction communicates with the ink channel 35.

The communicating hole 32 which communicates with one end of each of the pressure chambers 31 is formed in the base plate 26 which is adjacent to a lower surface of the cavity plate 27, and the connecting channel 33 which supplies the ink from the common ink chamber 34 to each of the pressure chambers 31 is formed in the supply plate 25 which is adjacent to a lower surface of the base plate 26.

In the two manifold plates 24*a* and 24*b*, eight common ink chambers 34 extended along the X direction are formed as through holes, each extending along one of the rows of nozzles 7. The eight common ink chambers (manifold chambers) 34 are formed by stacking or laminating the two manifold plates 24*a* and 24*b*, then covering an upper surface thereof by the supply plate 25 and covering a lower surface thereof by the damper plate 23. As viewed from a direction in which the plates are stacked (stacking direction), each of the common ink chambers 34 partially overlaps with the pressure chambers 31 in one of the pressure-chamber rows, and is extended along a direction of rows of the pressure chambers 31 (direction of the rows of the nozzles 7).

As shown in FIG. 7, damper chambers 36 isolated from the common ink chambers 34, respectively, are formed as grooves in the lower surface of the damper plate 23 which is adjacent to the lower surface of the manifold plate 24*a*. Each of the damper chambers 36 is located at a position in a plan view and has a shape in a plan view which match with a position and a shape of one of the common ink chambers 34 (see FIG. 6). Since the damper plate 23 is formed of a metallic material which is elastically deformable, a ceiling portion (damper wall) 36*a* in a form of a thin plate on an upper portion of the damper chamber 36 is capable of vibrating freely toward the common ink chamber 34 and toward the damper chamber 36. At the time of ink discharge, even when a pressure fluctuation (pressure wave) generated in a certain pressure chamber 31 is propagated to the common ink chamber 34, then the roof portion 36*a* elastically deforms to vibrate, thereby making it possible to attenuate the pressure fluctuation by absorbing the pressure fluctuation (damper effect). Therefore, it is possible to suppress the occurrence of phenomenon in which the pressure fluctuation in the certain pressure chamber 31 is propagated to another pressure chamber 31 (cross talk).

On a side of one edge portion (edge portion in the X direction), of edge portions of the cavity plate 27 which are parallel to the Y direction, eight pieces of the ink supply ports 37 described above are formed as ink inlets for supplying the ink from the ink storage section 6 to the head unit 2, and eight connecting ports 38 are formed in each of the base plate 26 and the supply plate 25, corresponding to these ink supply ports 37 respectively. Accordingly, the ink is supplied toward one end portion in the longitudinal direction of each of the common ink chambers 34 via the ink supply port 37 and the connecting port 38. A filter 39 (see FIG. 2) which removes impurities in the ink is fixed with an adhesive or the like to each of the eight ink supply ports 37.

In this cavity unit 10, the ink, after being supplied from the ink supply source to one of the common ink chambers 34 via the ink storage section 6 and the ink supply port 37, is distributed to each of the pressure chamber 31 via one of the connecting channels 33 in the supply plate 25 and one of the communicating holes 32 in the base plate 26. Further, the ink from each of the pressure chambers 31 reaches one of the nozzles 7 corresponding thereto through one of the through channels 35. In other words, in the cavity unit 10, ink channels (individual ink channels) are formed, each from one of the ink supply ports 37 reaching one of the nozzles 7, via one of the connecting ports 38, the common ink chamber 34, one of the connecting channels 33, one of the communicating holes 32, one of the pressure chambers 31, and one of the communicating channels 35. Further, the ink channels, which are formed corresponding to the eight nozzle rows respectively, are divided into two groups in the Y direction, with each group having four nozzle rows.

On the other hand, each of the two piezoelectric actuators 11, arranged side by side on the rear surface of one cavity unit 10, discharges the ink from nozzles 7 of the four nozzle rows (one group). The reason for dividing the piezoelectric actuator into two piezoelectric actuators 11 is that, although it is easy to form a large number of rows of ink channels in the cavity unit 10 by a method such as etching for a metallic material, it is difficult to make a large or multiple number of rows of electrodes corresponding to the pressure chambers, because a ceramics material which forms the piezoelectric actuator is shrunk substantially when being calcinated. Therefore, the piezoelectric actuator is made by dividing into a group of plurality of piezoelectric actuators each for a small number of electrode rows.

The piezoelectric actuator 11 has a form of a plate (flat shape) having a size such that each of the piezoelectric actuators 11 covers the pressure chambers 31 arranged in four rows, and similarly as a publicly known piezoelectric actuator as disclosed, for example, in U.S. Pat. No. 6,595,628 (Japanese Patent Application Laid-open No. 2002-254634), includes a plurality of ceramics layers stacked in a direction (thickness direction) orthogonal to a flat direction (plane direction), and a plurality of electrodes (electrode layers) arranged on a surface of the stacked ceramics layers. Here, a plurality of sheets (green sheets) of a piezoelectric ceramics material are formed by mixing a ceramics powder, a binder, and a solvent; and by forming this mixture in a form of a plate having a thickness of about 30 μm. Then, among the green sheets formed in such manner, electrodes are formed in a predetermined number of green sheets on surfaces thereof with an electroconductive paste by a method such as printing, and then the plurality of green sheets including the green sheets on which the electrode are formed are stacked and calcinated, thereby forming the piezoelectric actuator 11. Accordingly, each of the green sheets becomes a ceramics layer of a sintered body.

The electrode layers include a layer of driving electrode and a layer of surface electrode. The layer of driving electrode includes an electrode layer of individual electrodes 41 which are formed for the pressure chambers 31 respectively, and an electrode layer of a common electrode 42 which is formed so as to cover the plurality of pressure chambers 31, and these layers form a pair in a stacking direction of the ceramics layers. The layer of surface electrode is a layer of the surface electrodes 43 (FIG. 5) arranged on the topmost surface of the stacked ceramics layers, and is electrically connected to the layer of the driving electrode via a through hole. A wiring pattern (not shown in the diagram) provided on the flexible flat cable 12 is electrically connected to the surface electrodes 43. In the piezoelectric actuator 11 provided with the electrode layers in such a manner, by applying a high voltage between an individual electrode 41 and a common electrode 42, it is possible to polarize a portion of the ceramics layer sandwiched between the two electrodes 41 and 42, and to form this portion as an active portion.

An adhesive sheet (not shown in the diagram) made of an ink non-permeable synthetic resin material is stuck (adhered) in advance, as an adhesive, on the entire lower surface (surface facing the pressure chambers 31, broad surface) of the plate type piezoelectric actuator 11 having such structure. Next, the individual electrodes 41 of the piezoelectric actuator 11 are made to correspond to the pressure chambers 31, respectively, in the cavity unit 10, and the piezoelectric actuator 11 is adhered and firmly fixed to the cavity unit 10. Further, the flexible flat cable 12 (see FIG. 5) is joined to the upper surface of the piezoelectric actuator 11.

A chip on flexible cable (COF) on which an IC (integrated circuit) chip is mounted, as a driving circuit 13, is used in an intermediate area in the longitudinal direction of the flexible portion 12*a* of each of the flexible flat cables 12. As shown in FIG. 3, a heat sink 8 is fixed by a screw to a portion toward each of side plates of the bottom plate 5*a* of the head holder 5, and the driving circuit 13 is sandwiched between the heat sink 8 and an elastic member (such as a sponge material and a rubber material) 14 which is fixed to the bottom plate 5*a*. Since the driving circuit 13 is tightly in contact with the heat sink by a bias (force imparted) of the elastic member 14, the heat generated from the driving circuit 13 is released or radiated assuredly by the heat sink 8.

In the ink-jet head 1 having such structure, for performing a recording by discharging the ink from desired nozzles, a driving signal is applied to the two piezoelectric actuators 11 via the flexible flat cables 12. When the recording operation is repeated, both the piezoelectric actuators 11 generate heat. However, since the driving signal in accordance with printing data is applied independently to the two piezoelectric actuators 11, sometimes there arises a difference in an amount of heat generated between the two piezoelectric actuators 11.

However, in this ink-jet head 1, the soaking member 4 arranged on the upper surfaces of the flexible flat cables 12 is provided such that the heat can be transmitted to the two piezoelectric actuators 11. Therefore, by shifting or transmitting the heat via the soaking member 4, a temperature gradient in one of the piezoelectric actuators 11, and a temperature gradient in the other piezoelectric actuator 11 adjacent to the one piezoelectric actuator 11 are suppressed. Further, a temperature difference between the inks in the two groups of ink channels is also suppressed. Accordingly, it is possible to prevent difference (unevenness) in operation characteristics from occurring in the piezoelectric actuators 11 and between the piezoelectric actuators 11, and it is possible to prevent difference (unevenness) in discharge characteristics of inks from occurring between the two groups of ink channels, to stabilize the operation, and to perform a recording of a high quality.

The cavity unit 10 may be formed independently for each of the piezoelectric actuators 11. However, when all the ink channels are formed integrally as in the embodiment, it can be anticipated that the heat is made to be uniform by transmitting the heat through a metallic plate material having a satisfactory or excellent thermal conductivity.

Figure 8A:
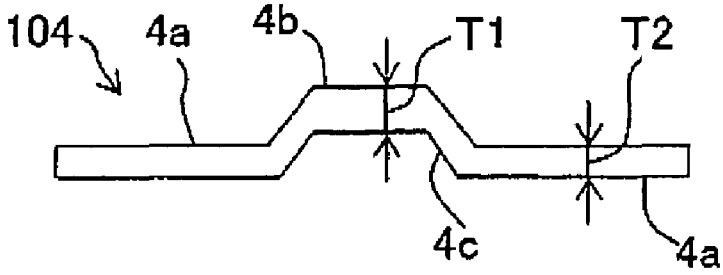
FIG. 8A to FIG. 8D are side views showing other examples of soaking member (thermal conductive member)

The soaking member 4 can be changed to various forms (shapes), other than the shape shown in FIG. 2. In a soaking member 104 shown in FIG. 8A, a thickness T1 of the connecting portion 4*b* is greater than a thickness T2 of each of the flat portions 4*a*. By making the connecting portion 4*b* thick, a heat resistance of the connecting portion 4*b* is decreased, thereby obtaining an effect that the heat is easily transmitted between the adjacent flat portions 4*a*.

Figure 8B:
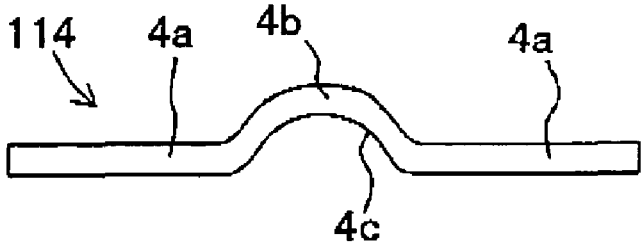

In a soaking member 114 shown in FIG. 8B, the connecting portion 4*b* is formed to have a curved shaped as a whole so as to straddling over the column portion 3*b* of the reinforcing frame 3. By making the entire connecting portion 4*b* to be curved shaped, it is possible to form the soaking member 114 easily by a process such as press working.

Figure 8C:
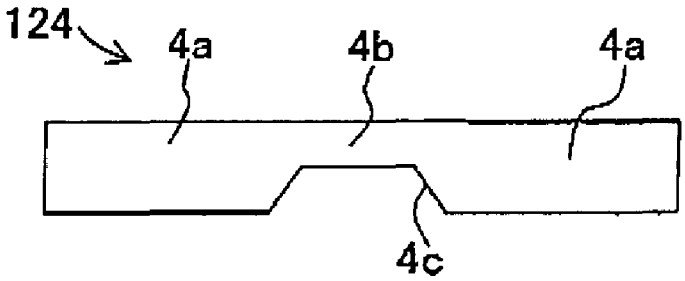

In a soaking member 124 shown in FIG. 8C, the thickness of each of the flat portions 4*a* is greater than the thickness of the connecting portion 4*b*. It is possible to make such soaking member 114 by forming in advance a depression 4*c*, by a process such as cutting, in a plate member having a uniform thickness entirely. In such a soaking member 114, a heat radiating effect and a soaking effect in the flat portions 4*a* is improved.

Figure 8D:
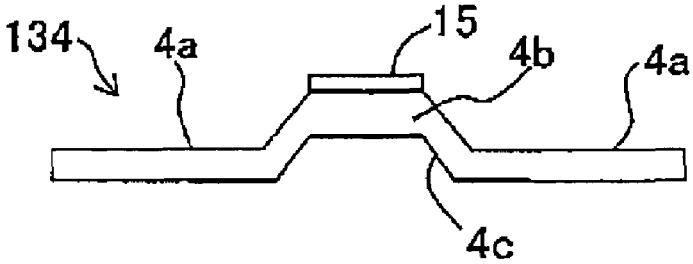

In a soaking member 134 shown in FIG. 8D, a heat insulating member 15 is fixed to a surface, of a connecting portion 4*b*, opposite to a surface in which a depression 4*c* is formed. Due to the heat insulating member 15, it is possible to suppress the heat radiation from the connecting portion 4*b*, and to facilitate or expedite the heat conduction between the flat portions 4*a* via the connecting portion 4*b*.

Figure 9A:
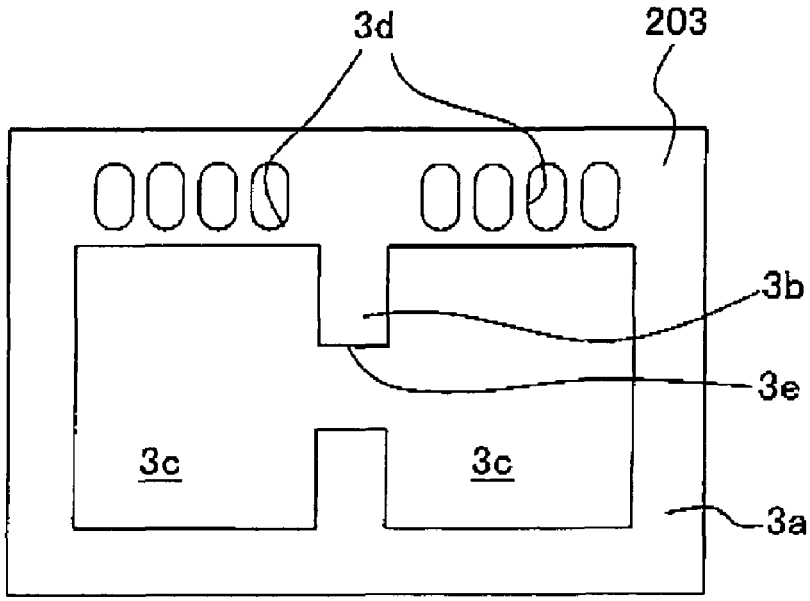
FIG. 9A is a plan view showing another example of a reinforcing frame.
Figure 9B:
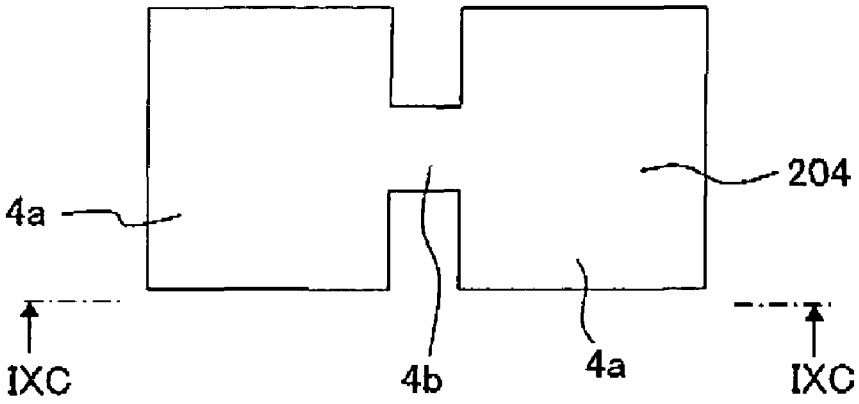
FIG. 9B is a plan view of a soaking member which is made to correspond to the reinforcing frame in FIG. 9A.
Figure 9C:
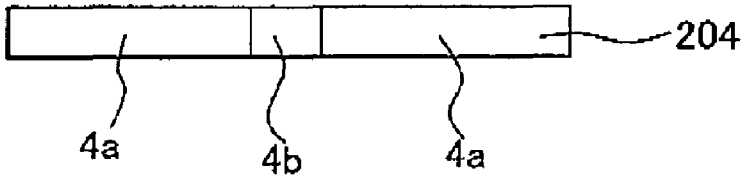
FIG. 9C is a cross-sectional view taken along a line IXc-IXc shown in FIG. 9B.

As still another example, as shown in FIGS. 9A to 9C, a column portion 3*b* may be divided by a cut line 3*e* in the column portion 3*b* of a reinforcing frame 203 in advance, and the connecting portion of a soaking member 204 may be formed to have a width thinner (smaller) than a gap of the cut line 3*e*. In this state, as compared to a case in which the cut line 3*e* is not formed, the stiffness of the reinforcing frame 204 is slightly decreased, but in addition that a process for making the column portion 4*b* straddle over the connecting portion 4*b* of the soaking member 204 (process for forming a depression or a curve in the soaking member 204) is unnecessary, it is possible to form the entire soaking member 204 to be thin, thereby making it possible to form the entire head unit 6 to be thin.

Although not shown in the diagram, when the reinforcing frame 3 is in the form only of a frame of the outer peripheral portion 3*a*, and does not have the column portion 3*b*, the soaking member may be formed by using a plate having a rectangular shape and a uniform thickness as a whole. In this case, it is possible to form the soaking member extremely easily.

Further, in the above explanation, the two piezoelectric actuators 11 are arranged on one cavity unit 10. However, the number of the piezoelectric actuators is not restricted to two, and may be not less than three. Furthermore, when the ink-jet head has at least three piezoelectric actuators, all the piezoelectric actuators may be connected (linked) to one soaking member so as to have a thermal conduction, by using a plurality of soaking members each of which connects two piezoelectric actuators, for example. Alternatively, among at least three piezoelectric actuators, only two predetermined piezoelectric actuators may be connected by the soaking member. Thus, an arrangement of the soaking member for the plurality of piezoelectric actuators may be made arbitrarily. Further, in the above embodiment, the flexible flat cable 12 is arranged for each of the piezoelectric actuators 11. However, one flexible flat cable 12 may be arranged spreading over and cover adjacent piezoelectric actuators 11.

Further, as the actuator, an example of a piezoelectric actuator was explained. However, another actuator of driving type may be adopted as the actuator provided that the actuator is a heat generating actuator.

In the embodiment described above, the description was made by giving an example of an ink-jet head of serial type. However, the present invention is also applicable to an ink-jet head of line type. Further, a liquid droplet jetting head of the present invention is not limited to an ink-jet head which jets the ink from nozzles, and the present invention is also applicable to a liquid droplet jetting head, other than the ink-jet head, which jets a liquid other than ink such as a reagent, a biomedical solution, a wiring material solution, an electronic material solution, a cooling medium (refrigerant), a liquid fuel, or the like. Furthermore, a liquid droplet jetting apparatus of the present invention also is not limited to an ink-jet printer which jets ink from the nozzles, and the present invention is also applicable to a liquid droplet jetting apparatus which jets various liquids mentioned above, for example.

What is claimed is:

1. A liquid discharging head which discharges a liquid, comprising:

a cavity unit including a channel through which the liquid flows, and a plurality of nozzles;

a plurality of actuators which selectively apply a discharge pressure to the liquid in the cavity unit, and which are arranged on a surface of the cavity unit;

a thermal conductive member which is arranged on two adjacent actuators among the actuators so that the two adjacent actuators are intervened between the thermal conductive member and the cavity unit and that the thermal conductive member thermally connects the two adjacent actuators, the thermal conductive member having flat portions which are arranged on the actuators, respectively, and a connecting portion which joins the flat portions;

a driving circuit which drives the actuators; and a heat sink which is thermally connected to the driving circuit and which is arranged not to face the thermal conductive member.

2. The liquid discharging head according to claim 1, further comprising:

a flexible flat cable which transmits a driving signal to the actuators;

wherein the liquid discharging head is an ink-jet head which discharges an ink.

3. The liquid discharging head according to claim 2;

wherein the flexible flat cable is provided on surfaces, of the actuators, on the side opposite to the cavity unit; and wherein the thermal conductive member is arranged on the actuators via the flexible flat cable.

4. The liquid discharging head according to claim 2;

wherein the cavity unit further includes a plurality of pressure chambers;

wherein the pressure chambers communicate with the channel, and are open toward the surface of the cavity unit on which the actuators are arranged; and wherein each of the actuators includes a plurality of piezoelectric bodies each of which has a shape of a flat plate, and the piezoelectric bodies cover the pressure chambers so as to divide the pressure chambers into groups corresponding to the piezoelectric bodies, respectively.

5. The liquid discharging head according to claim 2;

wherein the driving circuit is an IC chip, and the flexible flat cable is a chip-on flexible cable on which the IC chip is mounted.

6. The liquid discharging head according to claim 1, further comprising:

a reinforcing frame which includes an outer peripheral portion surrounding a periphery of each of the actuators;

wherein the reinforcing frame is arranged on the surface of the cavity plate on which the actuators are arranged; and wherein the thermal conductive member is arranged on inside of the outer peripheral portion of the reinforcing frame.

7. The liquid discharging head according to claim 6;

wherein the reinforcing frame is provided with a column portion which continues to the outer peripheral portion and which is disposed at a portion between the two adjacent actuators; and wherein a depression straddling over the column portion is formed on a surface, facing the column portion, of the connecting portion of the thermal conductive member.

8. The liquid discharging head according to claim 7;

wherein the connecting portion of the thermal conductive member has a curved shape and straddles over the column portion; and wherein a thickness of the connecting portion is greater than a thickness of the flat portions.

9. The liquid discharging head according to claim 6;

wherein the reinforcing frame is provided with a column portion which is disposed at a portion between the two adjacent actuators and which continues to the outer peripheral portion;

wherein the column portion is divided to define a gap with a predetermined spacing distance; and wherein the connecting portion of the thermal conductive member has a size such that the connecting portion is accommodated in the gap.

10. The liquid discharging head according to claim 6;

wherein a heat insulating material which suppresses a heat radiation from the connecting portion is fixed on a surface of the connecting portion of the thermal conductive member.

11. The liquid discharging head according to claim 1;

wherein the thermal conductive member is formed of a material which is selected from a group consisting of aluminum, copper, and stainless steel.

12. A liquid discharging apparatus which discharges a liquid onto an object, the apparatus comprising:

a transporting mechanism which transports the object in a predetermined direction;

a head which includes:

a cavity unit including a channel through which the liquid flows, and a plurality of nozzles;

a plurality of actuators which selectively apply a discharge pressure to the liquid in the cavity unit, and which are arranged on a surface of the cavity unit; and a thermal conductive member which is arranged on two adjacent actuators among the actuators so that the two adjacent actuators are intervened between the thermal conductive member and the cavity unit and that the thermal conductive member thermally connects the two adjacent actuators; and a reinforcing frame which includes an outer peripheral portion surrounding a periphery of each of the actuators;

wherein the reinforcing frame is arranged on the surface of the cavity plate on which the actuators are arranged.

13. The liquid discharging apparatus according to claim 12, further comprising:

a flexible flat cable which transmits a driving signal to the actuators;

wherein the liquid discharging apparatus is an ink-jet printer which performs recording by discharging an ink onto the object.

14. The liquid discharging apparatus according to claim 13;

wherein the flexible flat cable is arranged on surfaces of the actuators on the side opposite to the cavity unit; and wherein the thermal conductive member is arranged on the actuators via the flexible flat cable.

15. The liquid discharging apparatus according to claim 13;

wherein the cavity unit further includes a plurality of pressure chambers;

wherein the pressure chambers communicate with the channel, and are open toward the surface of the cavity unit on which the actuators are arranged; and wherein each of the actuators includes a plurality of piezoelectric bodies each of which has a shape of a flat plate, and the piezoelectric bodies cover the pressure chambers so as to divide the pressure chambers into groups corresponding to the piezoelectric bodies, respectively.

16. The liquid discharging apparatus according to claim 12;

wherein the thermal conductive member has flat portions which are arranged on the actuators, and a connecting portion which joins the flat portions, and the thermal conductive member is arranged on inside of the outer peripheral portion of the reinforcing frame.

17. The liquid discharging apparatus according to claim 16;

wherein the reinforcing frame is provided with a column portion which continues to the outer peripheral portion and which is disposed at a portion between the two adjacent actuators; and wherein a depression straddling over the column portion is formed on a surface, facing the column portion, of the connecting portion of the thermal conductive member.

18. The liquid discharging apparatus according to claim 17;

wherein the connecting portion of the thermal conductive member has a curved shape and straddles over the column portion; and wherein a thickness of the connecting portion is greater than a thickness of the flat portions.

19. The liquid discharging apparatus according to claim 16;

wherein the reinforcing frame is provided with a column portion which is disposed at a portion between the two adjacent actuators and which continues to the outer peripheral portion;

wherein the column portion is divided to define a gap with a predetermined spacing distance; and wherein the connecting portion of the thermal conductive member has a size such that the connecting portion is accommodated in the gap.

20. The liquid discharging apparatus according to claim 16;

wherein a heat insulating material which suppresses a heat radiation from the connecting portion is fixed on a surface of the connecting portion of the thermal conductive member.

* * * * *